United States Patent [19]

Salyards

[11] Patent Number: 5,007,123

[45] Date of Patent: Apr. 16, 1991

[54] FLEXIBLE COVERING FOR REDUCING MOISTURE/VAPOR/BACTERIA TRANSMISSION

[75] Inventor: Donald M. Salyards, Winona, Minn.

[73] Assignee: Comfortex, Inc., Winona, Minn.

[21] Appl. No.: 548,243

[22] Filed: Jul. 5, 1990

[51] Int. Cl.[5] ..... A47C 27/00

[52] U.S. Cl. ..... 5/448; 5/459; 5/470; 5/473; 5/483; 5/484

[58] Field of Search ..... 5/448, 459, 470, 471, 5/473, 483, 484, 499, 500; 128/849, 206.19

[56] References Cited

U.S. PATENT DOCUMENTS

| | | | |
|---|---|---|---|
| 3,384,908 | 5/1968 | Janapol | 5/484 |
| 4,136,413 | 1/1979 | Scales | 5/484 X |
| 4,504,990 | 3/1985 | Scales et al. | 5/459 |
| 4,507,342 | 3/1985 | Kielbania et al. | 428/290 X |
| 4,525,409 | 6/1985 | Elesh | 5/483 X |
| 4,684,570 | 8/1987 | Malaney | 128/849 X |
| 4,690,859 | 9/1987 | Porter et al. | 5/459 X |
| 4,700,313 | 11/1987 | Murphy | 5/473 X |
| 4,801,493 | 1/1989 | Ferziger et al. | 5/459 X |
| 4,961,985 | 10/1990 | Henn et al. | 128/849 X |

*Primary Examiner*—Michael F. Trettel

*Attorney, Agent, or Firm*—Oblon, Spivak, McClelland, Maier & Neustadt

[57] ABSTRACT

A flexible covering for reducing vapor transmission to a core of a mattress includes outer and inner coverings respectively forming first and second moisture/vapor/-bacteria barriers, the outer and inner coverings being formed of materials having a flexibility sufficient to reduce tissue pressures which cause the formation of pressure sores on the body of a patient. The material of the outer and inner coverings comprise one of a woven and/or non-woven materials having or forming a vapor barrier such that the outer and inner coverings have a vapor transmission of less than 10.7 grams per hour per meter$^2$. According to one embodiment of the present invention, the covering forms an integral part of the mattress or forms an envelope covering the core thereof.

20 Claims, 4 Drawing Sheets

FLEXIBLE COVERING FOR REDUCING MOISTURE/VAPOR/BACTERIA TRANSMISSION

BACKGROUND OF THE INVENTION

1. Field of the Invention

The present invention generally relates to a flexible covering for reducing vapor, moisture, and/or bacterial transmission therethrough, and more particularly, to a flexible covering for at least a sleeping surface of a mattress, the covering having a flexibility sufficient to reduce localized concentration of pressure on a body positioned on the mattress as well as forming a vapor barrier for minimizing moisture, vapor and bacterial build-up within the core of the mattress.

2. Discussion of the Background

Therapeutic mattresses, for example, as disclosed by U.S. Pat. No. 4,706,313, assigned to the assignee of the present application, are preferably adapted to the special requirements needed for extended use by bed-ridden patients. Additionally, the fabrics or coverings employed as bedding for therapeutic mattresses, such as disclosed by U.S. Pat. No. 4,525,409, are also specially chosen and adapted for use by people confined to bed over an extended period of time.

Such special requirements include the prevention of pressure sores as well as the build-up of moisture, vapor and bacteria within the core of the mattress. Typically, the moisture, vapor and bacteria are transmitted through a covering of the mattress to the core as a result of incontinence, perspiration as well as unintentionally spilled liquids.

A major cause of pressure sores is localized concentration of pressure on the body of the patient due to the weight of the patient pressing down onto the surface of the mattress. This concentration of pressure results in a compression of soft tissues and a corresponding reduction in blood flow which promotes the formation of decubitus ulcers and the like.

Conventional solutions for reducing the localized concentration of pressure include the use of pliant materials having sufficient flexibility to mitigate sheering, i.e., friction against the skin, when a patient moves or sinks into the mattress which might otherwise arise due to the use of less pliant materials.

Moisture and vapor build up in the core of the mattress is a problem because it provides a breeding ground for bacteria, causes unpleasant odors and presents a risk of cross-contamination with multiple patient use. Conventional solutions for reducing moisture, vapor and bacteria build-up include providing a mattress cover or envelope, formed of vinyl, rubber or other waterproof materials, at a sleeping surface of the mattress. However, the most effective waterproofing materials are thick, stiff and hard, resulting in a flexibility which is ineffective in preventing body sores resulting from pressure. On the other hand, more pliant waterproof fabrics, which have a flexibility sufficient to mitigate the formation of body sores, have been found to be ineffective in reducing moisture, vapor and bacteria build-up in the core.

A further deficiency of disclosed, therapeutic mattresses is the failure to recognize that moisture and bacteria buildup in the core of the mattress results not only from the transfer of liquids, but also from the transfer of moisture vapor.

SUMMARY OF THE INVENTION

Therefore, one object of the present invention is to provide a flexible covering for reducing moisture and bacteria build up within the core of a mattress due to vapor transmission.

A further object of the present invention is to provide a flexible covering for minimizing the build up of moisture, vapor and bacteria within the core of a mattress without reducing the flexibility of the covering to the extent that it significantly reduces therapeutic value in mitigating the formation of pressure sores.

Yet a further object of the present invention is to provide a therapeutic mattress having a flexible covering for minimizing the build up of moisture and bacteria within the core of the mattress due to vapor transmission and having a flexibility sufficient to mitigate the formation of pressure sores.

These and other objects, features and advantages of the present invention are achieved, according to one embodiment of the present invention, by a flexible covering including an outer covering, which forms a first moisture/vapor/bacteria barrier, having a flexibility sufficient to prevent tissue pressures which cause the formation of pressure sores. Also included is an inner covering for forming a second moisture/vapor/bacteria barrier, the inner covering being positioned between the outer covering and the core of the mattress and having a flexibility substantially equal to that of the outer covering. The inner and outer coverings are made of materials selected such that moisture vapor transmission through both the outer and inner coverings is less than about 10.7 grams per hr per meter$^2$ at a temperature of about 99 degrees F. and a relative humidity of about 85%.

According to a further embodiment of the present invention, a sanitary and therapeutic mattress is provided which includes a core as well as an outer covering which forms a first moisture/vapor/bacteria barrier and has a flexibility sufficient to prevent tissue pressures which cause pressure sores. Also included is an inner covering, forming a second moisture/vapor/ bacteria barrier, and having a flexibility substantially equal to that of the outer covering, the inner covering being positioned between the outer covering and the core of the mattress.

One particular feature of the therapeutic mattress of the present invention is that the inner and outer coverings can form an integral part of the mattress, for example, at a sleeping surface of the mattress or an envelope covering the core of the mattress.

The material of the outer and inner coverings preferable comprise one of woven, non-woven or film materials forming or having a moisture/vapor/bacteria barrier. This moisture/vapor/bacteria barrier comprises, for example, a coating of an elasticity base including a polyvinyl chloride (PVC) and/or polyurethane compound. The coating mix may or may not be attached to a base fabric or substrate and can stand alone as a film material. Further, the flexibility of the coating shall be sufficient to reduce tissue pressures which cause the formation of pressure sores.

The woven fabrics comprising the base fabric or substrate to which the moisture/vapor/bacteria barrier is applied can include, for example, cotton, nylon and polyester. Preferably, the woven fabrics have a tight weave, on the order of about 70 denier. Additionally, the material of the inner and outer coverings can be made of the same materials or different materials or combinations of materials and may further include fire retardant additives, antibacterial additives, and a silicone finish.

Moreover, according to a preferred embodiment of the present invention, the material of at least one of the inner and outer coverings comprises a 70 denier fabric with a moisture/vapor/bacteria barrier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
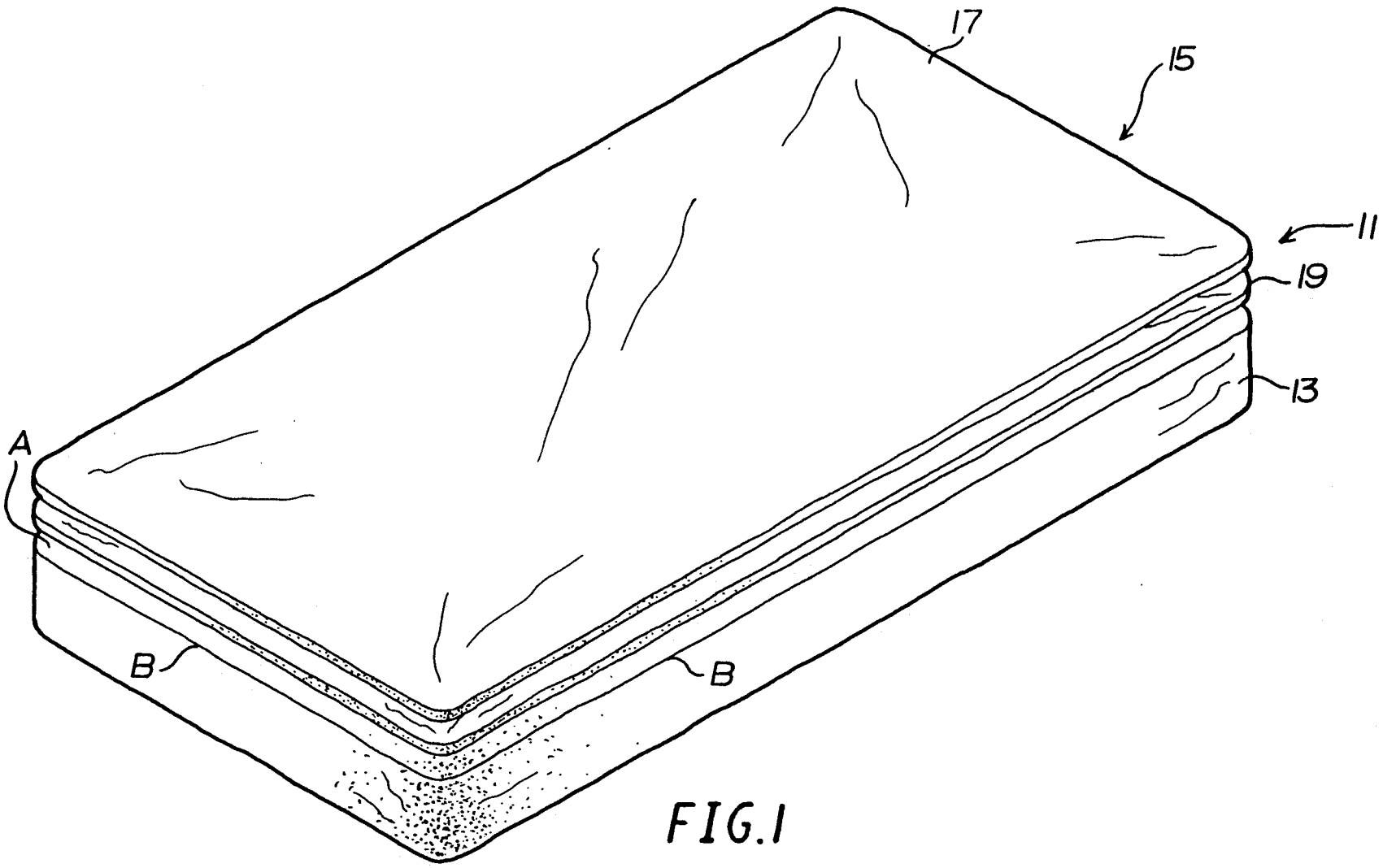
FIG. 1 is an exploded, perspective view of one embodiment of the flexible covering for reducing moisture/vapor/ transmission to a core of a mattress according to the present invention.

Various other objects, features and attendant advantages of the present invention will be more fully appreciated as the same becomes better understood from the following detailed description when considered in connection with the accompanying drawings in which like reference characters designate like or corresponding parts throughout the several views.

Referring to FIG. 1, a mattress, generally indicated at 11, is illustrated and includes an absorbent core 13, for example a foam core. A flexible covering, generally indicated at 15, for reducing moisture/vapor/bacteria transmission to the core 13 of the mattress 11, includes an outer covering 17 and an inner covering 19 positioned between the outer covering 17 and the core 13 of the mattress 11.

Preferably, the outer covering 17 has a larger area than that of the foam core 13 so as to be loosely held at the top of the mattress 11, for example, by attachment of the covering 15 at the longitudinal and lateral edges B of a sleeping surface A of the mattress 11. As a result, the outer covering 17 is "bloused" so that if a patient moves or sinks into the mattress, any sheering force and accompanying pressure on tissue which might otherwise arise are absorbed by sliding between the outer covering 17 and the underlying foam core 13 of the mattress 11.

The outer and inner coverings 17, 19 respectively form and include first and second moisture/vapor/bacteria barriers, each covering having a flexibility sufficient to prevent tissue pressures which cause the formation of pressure sores on the body of a patient. In this regard, pressures less than about 37mm Hg in the trochanter region of the body and pressures of less than about 22 mm Hg in the sacrum region of the body are considered acceptable interface pressure readings. (See Table I below.)

The materials selected to form the outer and inner coverings 17, 19 can be the same material and preferably provide a moisture vapor transmission through the flexible covering 15 Which is less than about 10.7 grams/hr/meter$^2$ at a temperature of about 99 degrees F. and a relative humidity of about 85%. In this regard, the material forming the inner and outer coverings 17, 19 comprises at least a moisture/vapor/bacteria barrier which is a coating of an elastic base comprising a polyvinyl (PVC) and/or polyurethane compound. The coating mix may or may not be attached to a fabric or other base material and may stand alone as film material. The flexibility of the coating shall be sufficient to reduce tissue pressures which cause the formation of pressure sores to the acceptable levels as noted above.

The outer and inner coverings 17, 19 may include a base fabric or substrate of any woven fabric, such as, for example, cotton, nylon, polyester, or similar woven fabrics as well as non-woven materials or films. The base fabric is laminated, dipped or similarly processed to produce the moisture/vapor/bacteria barrier that significantly lowers the moisture vapor transfer (MVT) rate of the fabric.

When employing a woven fabric as the base fabric or substrate, the fabric is first woven then dyed and allowed to set. The fabric then is coated with an elastic base comprising at least one of a polyvinyl chloride and/or polyurethane compound, such as, for example, in accordance with the CARRYTECH process offered by Bradford Industries of Lowell, Mass.

Preferably, the outer covering 17 comprises a coated fabric as noted above and while the inner covering 19 can comprise a similarly coated fabric, the inner covering 19 can also comprise a different coated fabric or a film not attached to an original fabric. The material of the outer and inner layer 17, 19 can also include at least one of a fire retardant and antibacterial additive. Moreover, the material of at least one of the inner and outer layers, according to one embodiment of the present invention, comprises a 70 denier fabric coated with the moisture/vapor/bacteria barrier in accordance with the foregoing description.

Figure 2:
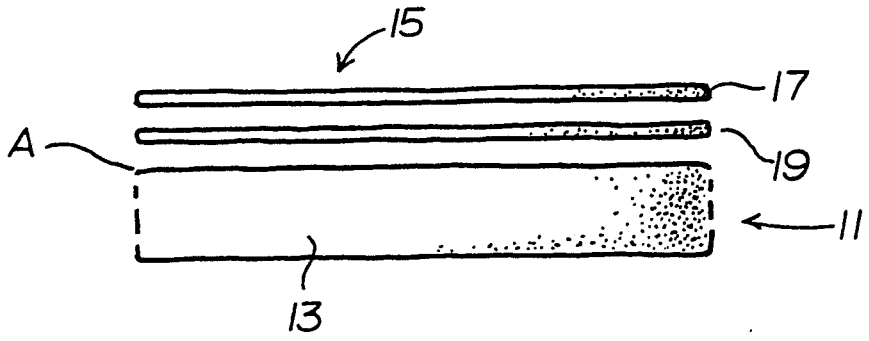
FIG. 2 is a partial, sectional view of a sanitary and therapeutic mattress according to one embodiment of the present invention wherein the flexible covering forms an integral part of th e mattress.

According to a further embodiment of the present invention, the flexible fabric covering 15 comprises an integral part of the mattress 11 as illustrated in FIG. 2. The outer covering 15 again is preferably bloused and the flexible covering 15 is positioned at the sleeping surface A of the mattress. In this embodiment the covering 15 is attached at the longitudinal and lateral edges B of the sleeping surface A by sewing, adhesives or the like.

Figure 3:
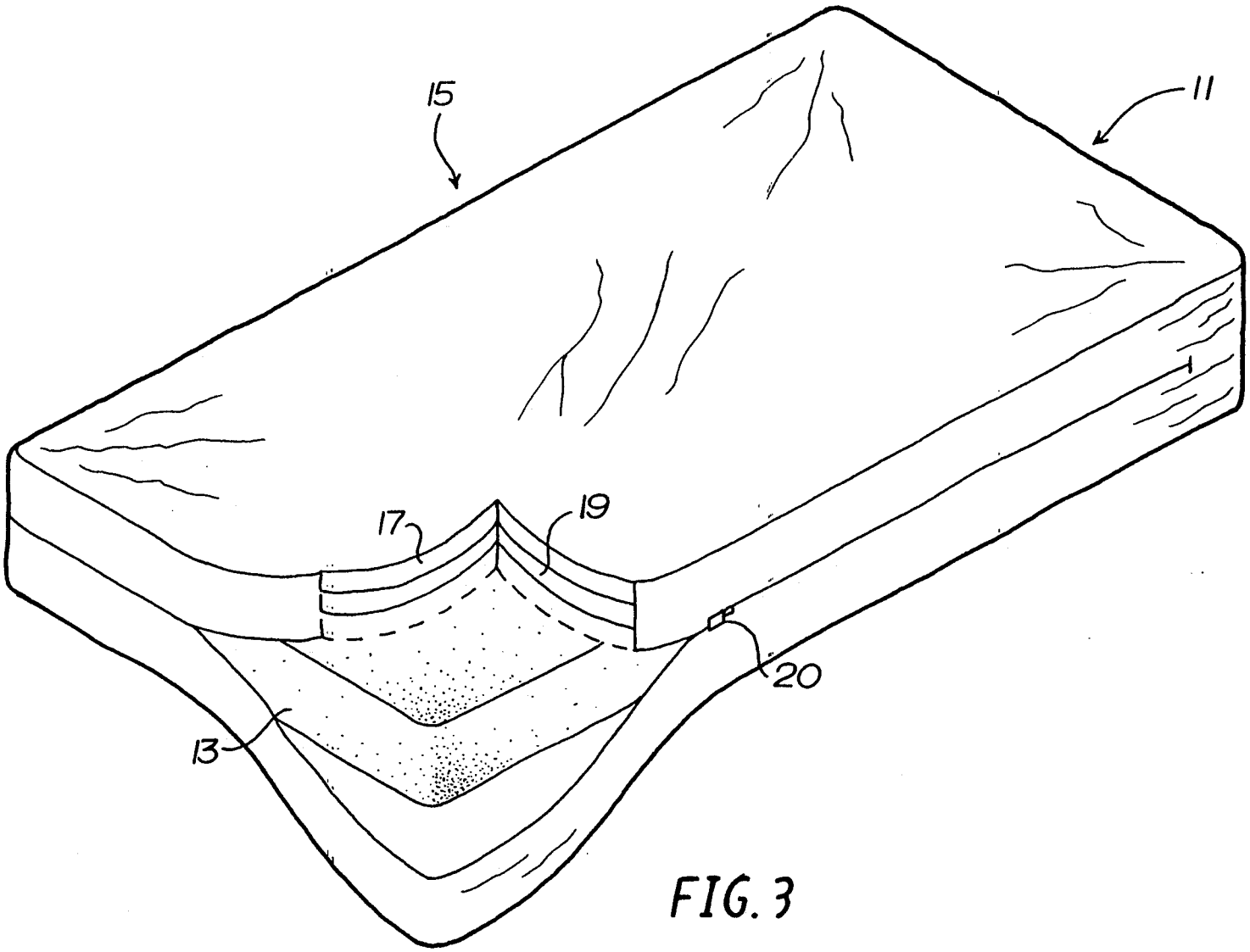
FIG. 3 is a perspective view of a further embodiment of the sanitary and therapeutic mattress of the present invention wherein the flexible covering forms an envelope for covering the core of the mattress.

According to a further embodiment of the present invention, as illustrated in FIG. 3, the flexible fabric 15 forms at least the top of an envelope covering the core 13 of the mattress 11. The envelope may be provided with a zipper 21 to permit removal as well as breathing of the foam core 13 or may be sewn completely shut and be provided with vents to permit breathing of the foam core of the mattress.

Figure 4:
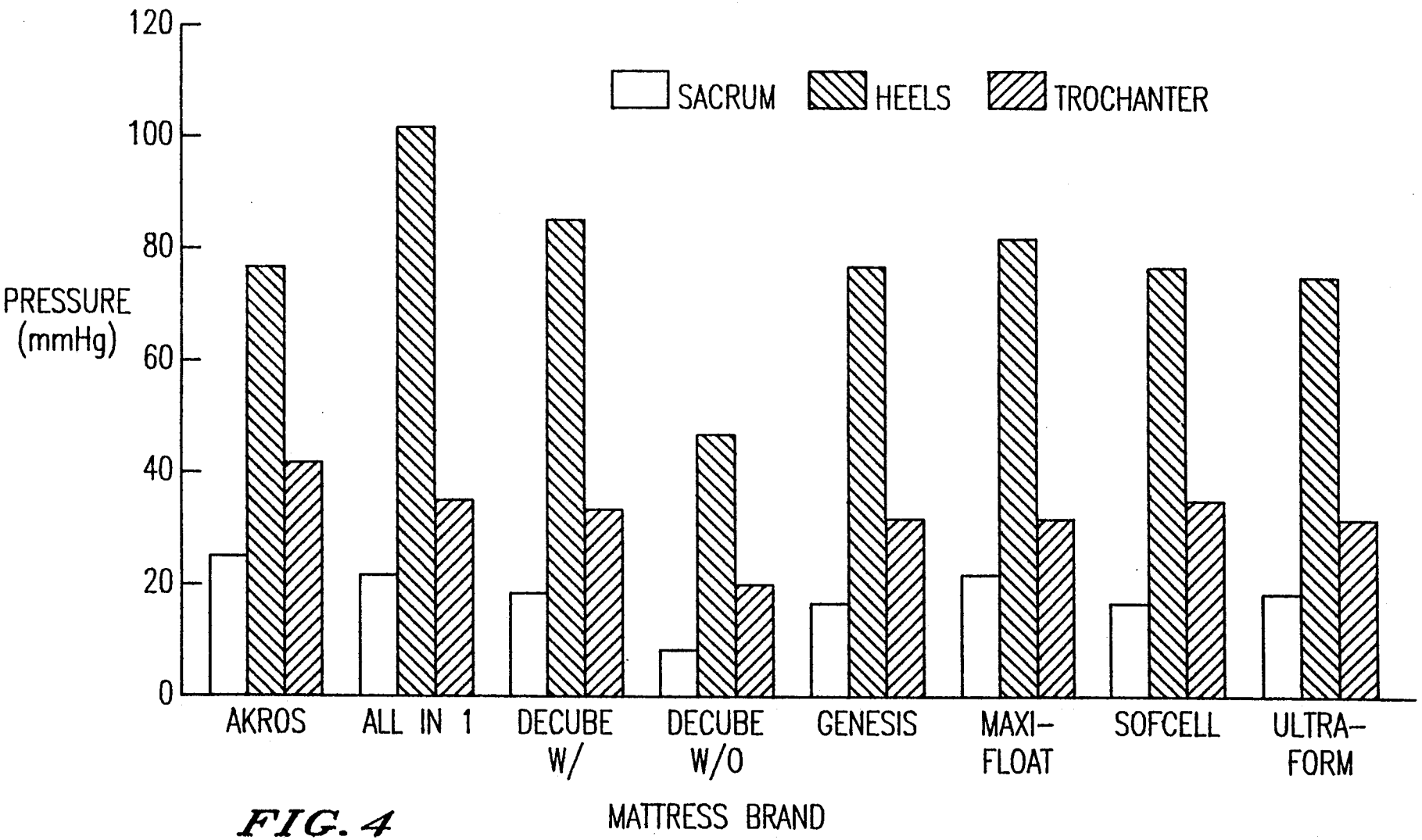
FIG. 4 is a bar graph illustrating the pressure exerted at the sacrum, heels and trochanter of a human body by various different brands of mattress.

Referring to Table 1 below and FIG. 4, the average pressure in MMHG for the heel, sacrum and trochanter for a group of patients are provided for various brands of mattresses. The DeCube and Genesis mattresses are produced by the Assignee of the present invention and incorporate the flexible fabric covering of the present invention.

TABLE 1

| Brand of Mattress | Average Pressure in MMHG | | |
|---|---|---|---|
| | Heel | Sacrum | Trochanter |
| Akros | 77.1 | 24.2 | 40.7 |
| All In One | 102.0 | 21.4 | 36.3 |
| DeCube w/ Cubes | 84.0 | 18.4 | 34.8 |
| DeCube w/o Cubes | 44.8 | 7.7 | 19.6 |
| Genesis | 77.0 | 17.5 | 33.7 |
| Maxifloat | 80.7 | 21.4 | 33.7 |
| Sofcell | 77.3 | 17.8 | 36.3 |
| Ultraform | 76.0 | 18.4 | 33.4 |

Referring to Table 2, water vapor transfer in grams per hour per meter$^2$ is shown for various hospital mattress fabrics. Again, the two layer DeCube and Genesis mattresses incorporate the flexible fabric covering of the present invention.

TABLE 2

Water Vapor Transfer for Hospital Mattress Fabrics (grams/hr./meter$^2$)

| Product Name/Fabric Type (one layer) | g/hr/m$^2$ |
|---|---|
| Standard Hospital Mattress/StaphChek 13.4 oz(N) | 2.4 |
| DeCube/70 denier nylon(F) | 5.4 |
| Genesis/70 denier nylon(F) | 5.4 |
| Akros/StapChek 6 oz.(N) | 3.8 |
| Ultraform/coated nylon(F) | 20.3 |
| Sofcell/coated nylon(F) | 22.6 |
| All-in-One/coated nylon(F) | 27.8 |
| Maxifloat/coated nylon(F) | 26.1 |
| Product Name/Fabric Type (two layers) | g/hr/m$^2$ |
| Standard Hospital Mattress/StaphChek 13.4 oz(N) | 1.3 |
| DeCube/(VaporSeal*)/70 denier nylon(F) | 2.4 |
| Genesis/(VaporSeal*)/70 denier nylon(F) | 2.4 |
| Akros/StapChek 6 oz.(N) | 2.6 |
| Ultraform/coated nylon(F) | 10.7 |
| Sofcell/coated nylon(F) | 13.5 |
| All-in-One/coated nylon(F) | 15.8 |
| Maxifloat/coated nylon(F) | 17.2 |

F denotes flexible fabric providing acceptable interface pressure readings
N denotes fabric too stiff to generate acceptable interface pressure readings
*denotes two layer cover as disclosed and claimed herein As shown in Table 2, conventional hospital mattresses with standard vinyl fabric such as StaphChek allow only minimum amounts of vapor transfer rendering them effective for six to ten years without accumulating significant amounts of odor or bacteria. However, these fabrics are thick, stiff and hard, negating their effectiveness in prevention of pressure sores. Further analysis of the FIG. 4 and Tables 1 and 2 illustrates that flexible fabrics, generally yield high MVT amounts. The higher the MVT number, the faster vapor will migrate to the mattress core, resulting in accumulation of moisture, bacteria and odors. However, an analysis of the mattresses incorporating the flexible covering disclosed by Applicant in the present application reveal that these mattresses not only have a low MVT figure, but also provide the patient with a low concentration of pressure on the noted bony prominences.

Obviously, numerous modifications and variations of the present invention are possible in light of the above teachings. It is therefore to be understood that within the scope of the appended claims, the invention may be practiced otherwise than as specifically described above.

WHAT IS CLAIMED AS NEW AND DESIRED TO BE SECURED BY LETTERS PATENT OF THE UNITED STATES IS:

1. A flexible covering for reducing moisture/vapor/bacteria transmission to a core of a mattress comprising:

an outer covering for forming a first moisture/vapor/bacteria barrier, the outer covering having a flexibility sufficient to reduce tissue pressures which cause the formation of body sores; and an inner covering for forming a second moisture/vapor/bacteria barrier, the inner covering being positioned between the outer covering and the core of the mattress and having a flexibility substantially equal to the flexibility of the outer covering;

wherein the outer and inner coverings are made of materials selected such that vapor transmission through both the outer and inner coverings is less than about 10.7 grams/hr/m$^2$ at a temperature of about 99 degrees F. and a relative humidity of about 85%.

2. A covering according to claim 1, wherein the outer covering is bloused.

3. A covering according to claim 2, wherein the material of the outer and inner coverings are one of a woven fabric, a non-woven material and film having a moisture/vapor/bacteria barrier.

4. A covering according to claim 3, wherein the moisture/vapor/bacteria barrier is a coating of an elastic base comprising at least one of a polyvinyl chloride and polyurethane compound.

5. A covering according to claim 3, wherein the woven fabric comprises at least one of cotton, nylon and polyester.

6. A covering according to claim 3, wherein the material of the outer and inner coverings are different.

7. A covering according to claim 3, wherein the material of at least one of the outer and inner coverings further includes at least one of a fire retardant and antibacterial additive.

8. A covering according to claim 3, wherein the material of at least one of the outer and inner coverings is a woven fabric having a tight weave in the range of about a seventy denier fabric, the woven fabric being coated with a moisture/vapor/bacteria barrier.

9. A covering according to claim 8, wherein the moisture/vapor/bacteria barrier is a coating of an elastic base comprising at least one of a polyvinyl chloride and polyurethane compound.

10. A sanitary and therapeutic mattress comprising:

a core;

an outer covering for forming a first moisture/vapor/bacteria barrier, the outer covering having a flexibility sufficient to reduce tissue pressures which cause the formation of body sores; and an inner covering for forming a second moisture/vapor/bacteria barrier, the inner covering being positioned between the outer covering and the core of the mattress and having a flexibility substantially equal to the flexibility of the outer covering;

wherein the outer and inner coverings are made of materials selected such that moisture vapor transmission through both the outer and inner coverings is less than about 10.7 grams/hr/mz at a temperature of about 99 degrees F and a relative humidity of about 85%.

11. A mattress according to claim 10, wherein the outer covering is bloused.

12. A mattress according to claim 11, wherein the outer and inner coverings form an integral part of the mattress.

13. A mattress according to claim 11, wherein the outer and inner coverings form at least a top of an envelope covering the core of the mattress.

14. A mattress according to claim 11, wherein the core of the mattress is made of at least one of foam material and a fibrous material.

15. A covering according to claim 11, wherein the material of the outer and inner coverings are one of a woven fabric, a non-woven material and a film having a moisture/vapor/bacteria barrier.

16. A covering according to claim 15, wherein the woven fabric comprises at least one of cotton, nylon and polyester.

17. A covering according to claim 15, wherein the material of the outer and inner coverings are different.

18. A covering according to claim 15, wherein the fabric further includes at least one of a fire retardant and antibacterial additive.

19. A covering according to claim 15, wherein the material of at least one of the outer and inner coverings is a woven fabric having a tight weave in the range of about a seventy denier fabric, the woven fabric being coated with a moisture/vapor/bacteria barrier.

20. A covering according to claim 19, wherein the moisture/vapor/bacteria barrier is a coating of elastic base and comprises at least one of a polyvinyl chloride and polyurethane compound.

* * * * *